US006155359A

United States Patent [19]

Gardner

[11] Patent Number: 6,155,359

[45] Date of Patent: Dec. 5, 2000

[54] VEHICLE MOUNTED POST HOLE DIGGER

[76] Inventor: John Gardner, 14185 N. US Hwy. 75, Willis, Tex. 77378-3425

[21] Appl. No.: 09/226,257

[22] Filed: Jan. 7, 1999

[51] Int. Cl.[7] ..... A01B 49/04; E21C 11/02

[52] U.S. Cl. ..... 175/170; 173/27

[58] Field of Search ..... 37/404, 466; 172/22, 172/25; 173/24, 25, 26, 27, 28, 29, 46, 184, 185–189; 175/162, 170

[56] References Cited

U.S. PATENT DOCUMENTS

| | | | |
|---|---|---|---|
| 3,789,931 | 2/1974 | Quinn | 173/22 |
| 4,066,134 | 1/1978 | Karns, III | 173/27 |
| 4,199,033 | 4/1980 | Van Gundy, Jr. | 173/27 |
| 4,869,002 | 9/1989 | Glenn | 37/466 |
| 4,998,590 | 3/1991 | Wells | 175/162 |
| 5,195,261 | 3/1993 | Vachon | 37/403 X |
| 5,263,809 | 11/1993 | Kent | 172/25 X |
| 5,558,169 | 9/1996 | Madgwick et al. | 173/28 X |
| 5,746,277 | 5/1998 | Howell, Jr. | 173/27 X |
| 5,944,452 | 8/1999 | Reinert, Sr. | 405/232 |

*Primary Examiner*—Robert E. Pezzuto

[57] ABSTRACT

A vehicle mounted post hole digger for digging post holes in the ground. The vehicle mounted post hole digger includes a spaced apart pair of adjustably extendible support braces with base pivotally coupled to forwards ends of the support braces. A first end of a telescopic boom arm is pivotally coupled to a first end of the base. A motor is pivotally coupled to a second end of the boom arm. The motor has a rotating shaft outwardly extending therefrom to which an elongate auger is attached.

9 Claims, 4 Drawing Sheets

VEHICLE MOUNTED POST HOLE DIGGER

BACKGROUND OF THE INVENTION

1. Field of the Invention

The present invention relates to vehicle mounted post hole diggers and more particularly pertains to a new vehicle mounted post hole digger for digging post holes in the ground.

2. Description of the Prior Art

The use of vehicle mounted post hole diggers is known in the prior art. More specifically, vehicle mounted post hole diggers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,869,002 by Glenn; U.S. Pat. No. 3,022,839 by Troche; U.S. Pat. No. 4,066,134 by Karns, III; PCT Patent No. WO 89/01892 by Frederick; PCT Patent No. WO 88/03221 by McMillan et al.; U.S. Pat. No. 4,961,471 by Ovens; and U.S. Pat. No. 2,217,300 by Templeton.

While these devices fulfill their respective, particular objectives and requirements, the aforementioned patents do not disclose a new vehicle mounted post hole digger. The inventive device includes a spaced apart pair of adjustably extendible support braces with base pivotally coupled to forwards ends of the support braces. A first end of a telescopic boom arm is pivotally coupled to a first end of the base. A motor is pivotally coupled to a second end of the boom arm. The motor has a rotating shaft outwardly extending therefrom to which an elongate auger is attached.

In these respects, the vehicle mounted post hole digger according to the present invention substantially departs from the conventional concepts and designs of the prior art, and in so doing provides an apparatus primarily developed for the purpose of digging post holes in the ground.

SUMMARY OF THE INVENTION

In view of the foregoing disadvantages inherent in the known types of vehicle mounted post hole diggers now present in the prior art, the present invention provides a new vehicle mounted post hole digger construction wherein the same can be utilized for digging post holes in the ground.

The general purpose of the present invention, which will be described subsequently in greater detail, is to provide a new vehicle mounted post hole digger apparatus and method which has many of the advantages of the vehicle mounted post hole diggers mentioned heretofore and many novel features that result in a new vehicle mounted post hole digger which is not anticipated, rendered obvious, suggested, or even implied by any of the prior art vehicle mounted post hole diggers, either alone or in any combination thereof.

To attain this, the present invention generally comprises a spaced apart pair of adjustably extendible support braces with base pivotally coupled to forwards ends of the support braces. A first end of a telescopic boom arm is pivotally coupled to a first end of the base. A motor is pivotally coupled to a second end of the boom arm. The motor has a rotating shaft outwardly extending therefrom to which an elongate auger is attached.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new vehicle mounted post hole digger apparatus and method which has many of the advantages of the vehicle mounted post hole diggers mentioned heretofore and many novel features that result in a new vehicle mounted post hole digger which is not anticipated, rendered obvious, suggested, or even implied by any of the prior art vehicle mounted post hole diggers, either alone or in any combination thereof.

It is another object of the present invention to provide a new vehicle mounted post hole digger which may be easily and efficiently manufactured and marketed.

It is a further object of the present invention to provide a new vehicle mounted post hole digger which is of a durable and reliable construction.

An even further object of the present invention is to provide a new vehicle mounted post hole digger which is susceptible of a low cost of manufacture with regard to both materials and labor, and which accordingly is then susceptible of low prices of sale to the consuming public, thereby making such vehicle mounted post hole digger economically available to the buying public.

Still yet another object of the present invention is to provide a new vehicle mounted post hole digger which provides in the apparatuses and methods of the prior art some of the advantages thereof, while simultaneously overcoming some of the disadvantages normally associated therewith.

Still another object of the present invention is to provide a new vehicle mounted post hole digger for digging post holes in the ground.

Yet another object of the present invention is to provide a new vehicle mounted post hole digger which includes a spaced apart pair of adjustably extendible support braces with base pivotally coupled to forwards ends of the support braces. A first end of a telescopic boom arm is pivotally coupled to a first end of the base. A motor is pivotally coupled to a second end of the boom arm. The motor has a rotating shaft outwardly extending therefrom to which an elongate auger is attached.

Still yet another object of the present invention is to provide a new vehicle mounted post hole digger that lets a user easily transport a post hole digging device to various locations to drill post holes in the ground.

Even still another object of the present invention is to provide a new vehicle mounted post hole digger that is pivotally mounted to a vehicle to permit variable positioning of the post hole digging device with respect to the vehicle so that the device may be used even when the vehicle is on an inclined surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
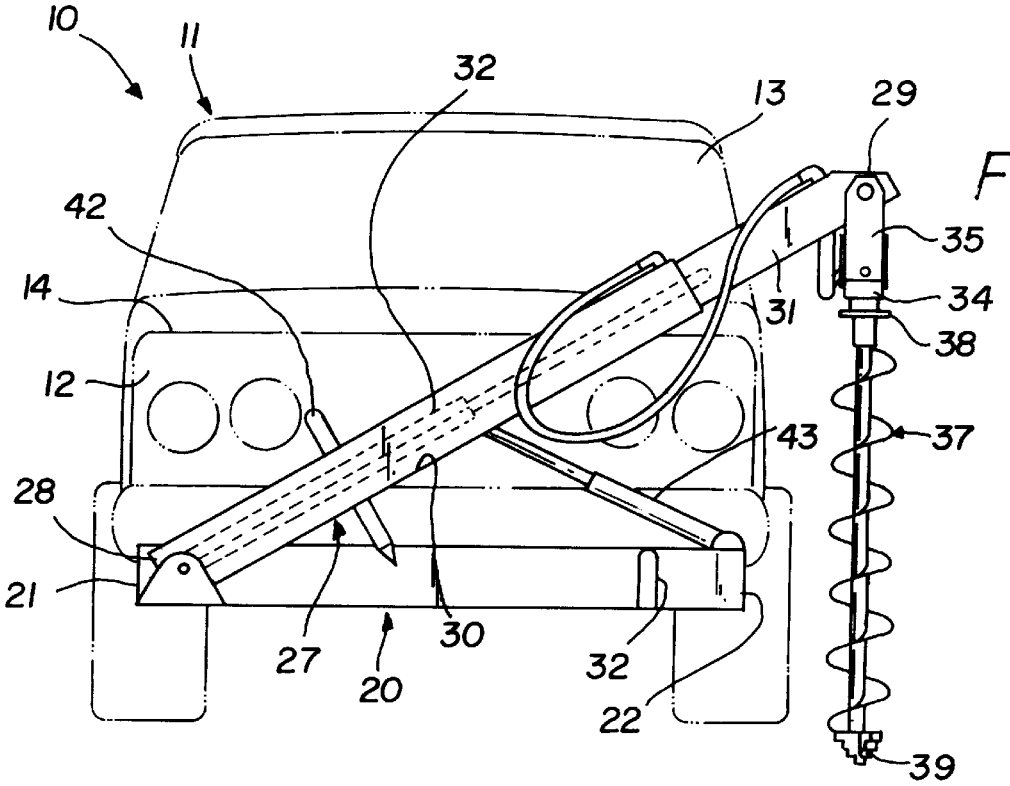
FIG. 1 is a schematic front view of a new vehicle mounted post hole digger with the auger in a deployed position for digging a hole in the ground according to the present invention.

With reference now to the drawings, and in particular to FIGS. 1 through 8 thereof, a new vehicle mounted post hole digger embodying the principles and concepts of the present invention and generally designated by the reference numeral 10 will be described.

As best illustrated in FIGS. 1 through 8, the vehicle mounted post hole digger 10 generally comprises a spaced apart pair of adjustably extendible support braces with base pivotally coupled to forwards ends of the support braces. A first end of a telescopic boom arm is pivotally coupled to a first end of the base. A motor is pivotally coupled to a second end of the boom arm. The motor has a rotating shaft outwardly extending therefrom to which an elongate auger is attached.

In closer detail, a motor vehicle 11 such as a truck is provided having a front end 12, a pair of sides, a passenger compartment 13 or cab, and an engine compartment 14. A spaced apart pair of adjustably extendible support braces 15, 16 are mounted beneath the front end of the vehicle. The support braces are preferably extended substantially parallel to one another and substantially perpendicular to the front end of the vehicle. Each of the support braces preferably comprises a pair of elongate portions 17, 18 with one portion of each support brace being telescopically extended from the other elongate portion of the respective brace. The support braces each have a forwards end 19 forwardly extending from the front end of the vehicle. The support braces each have a hole therethrough adjacent the forwards end of the respective support brace. Preferably, the holes of the support braces are substantially coaxial with one another.

An elongate base 20 is provided having a pair of opposite ends 21, 22. The base positioned in front of the front end of the vehicle and extended substantially perpendicular to the support braces. The base is pivotally coupled to the forwards ends of the support braces. Preferably, the base has a spaced apart pair of rearwardly extending pivot brackets 23. Each of the pivot brackets of the base has a hole therethrough which are substantially coaxial with one another. The forwards ends of the support brace are positioned between the pivot brackets of the base such that the holes of the support braces and the pivot brackets are generally coaxial with one another. A pivot axle 24 is extended through the holes of the support braces and the pivot brackets of the base to permit pivoting of the base with respect to the support arms about the pivot axle.

A first telescopic fluidic piston cylinder actuator 25 is connected to the base and one of the support arms whereby extension and retraction of the first telescopic fluidic piston cylinder actuator pivots the base with respect to the support braces. Additionally, the support braces are telescopically extended and retracted when the first telescopic fluidic piston cylinder actuator is extended and retracted accordingly. Preferably, the first telescopic fluidic piston cylinder actuator is extended substantially parallel to the support braces. The first telescopic fluidic piston cylinder actuator has an end 26 slidably mounted to the base to permit pivoting of the base with respect to the support braces when the first telescopic fluidic piston cylinder actuator is extended and retracted.

A telescopic boom arm 27 is provided having a pair of opposite ends 28, 29 and a longitudinal axis extending between the ends of the boom arm. The boom arm is telescopically extendable along the longitudinal axis of the boom arm and has a pair of elongate portions 30, 31. One of the portions of the boom arm is telescopically inserted into the other of the portions of the boom arm. A second telescopic fluidic piston cylinder actuator 32 is provided in the boom arm for telescopically extending and retracting the boom arm along the longitudinal axis of the boom arm.

Figure 2:
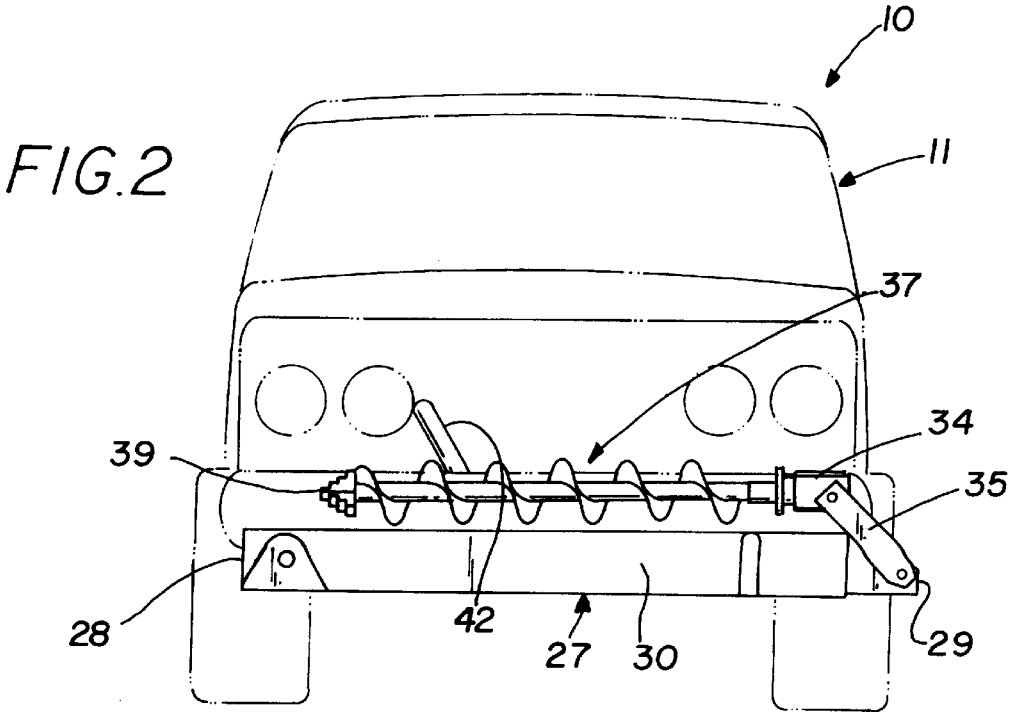
FIG. 2 is a schematic front view of the present invention with the boom arm in its lowered position.
Figure 3:
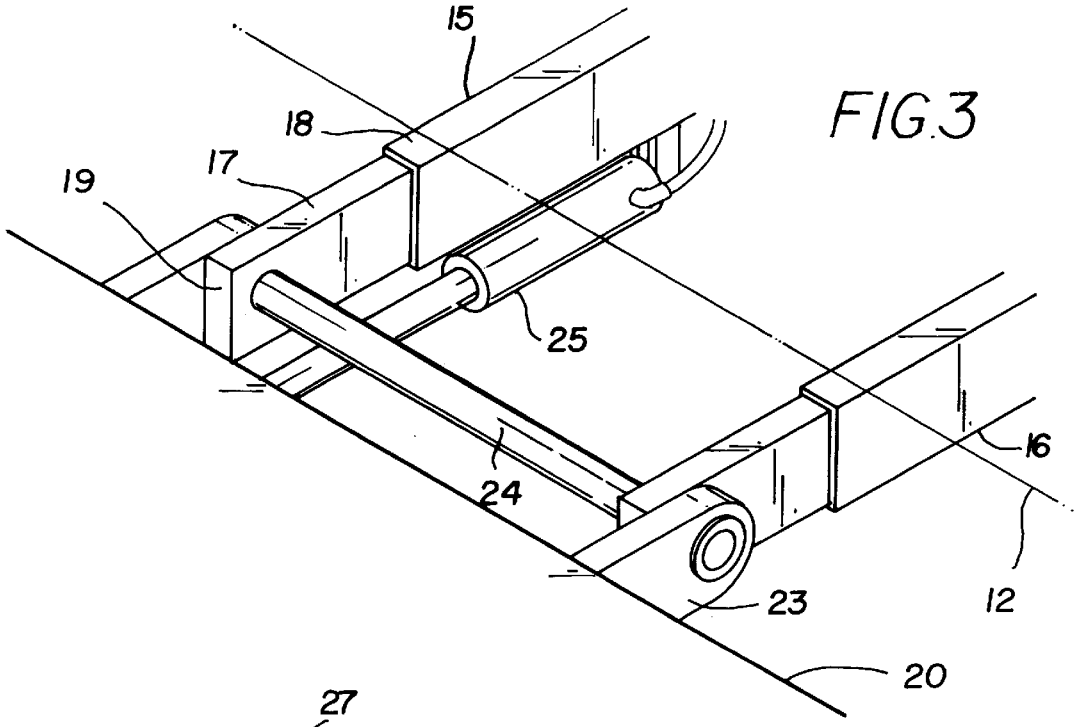
FIG. 3 is a schematic perspective view of the connection between the base and support braces of the present invention.
Figure 4:
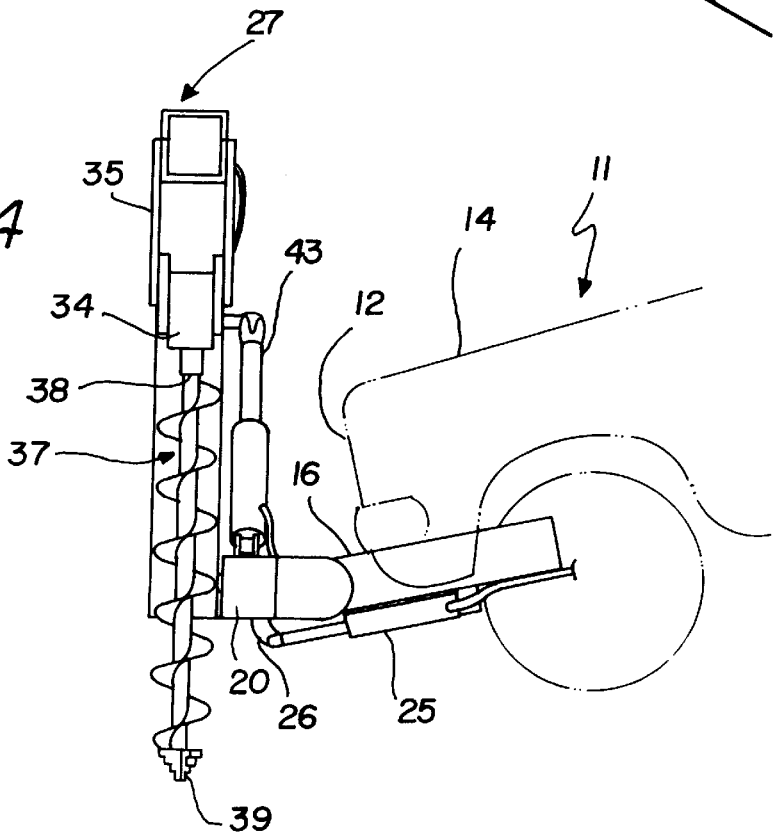
FIG. 4 is a schematic side view of the present invention.

A first of the ends of the boom arm is pivotally coupled to a first of the ends of the base to permit pivoting of the boom arm with respect to the base about a pivot axis extending substantially perpendicular to the longitudinal axis of the boom arm. In use, the boom arm is pivotable to a has a lowered position as illustrated in FIG. 2. In this lowered position the boom arm and the base are extended substantially parallel to one another. The base preferably has a boom rest 33 forwardly extending therefrom on which the boom arm rests when the boom arm is positioned in the lowered position.

Figure 5:
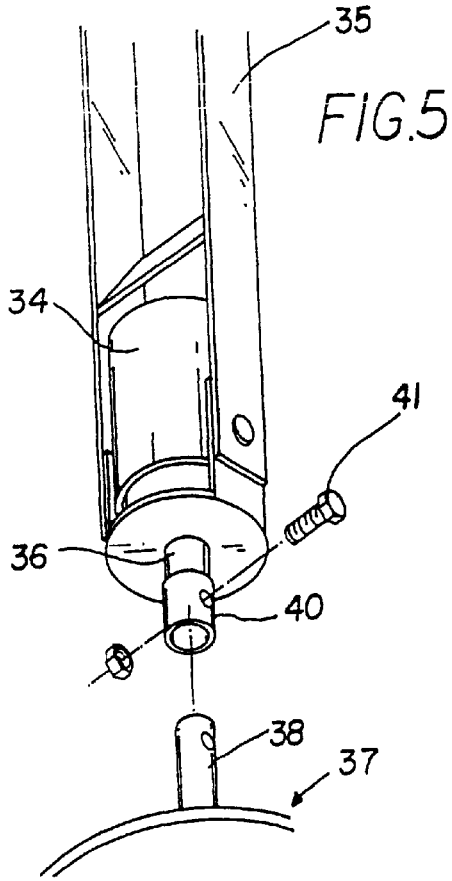
FIG. 5 is a schematic exploded perspective view of the area around the motor of the present invention.

A motor 34 is pivotally coupled to a second of the ends of the boom arm. Preferably, a mounting bracket 35 pivotally couples the motor to the second end of the boom. The motor has a rotating shaft 36 outwardly extending therefrom. An elongate auger 37 is provided having opposite mounting and digging ends 38, 39. In use, the auger is designed for boring a hole in a ground surface. The mounting end of the auger is detachably attached to the rotating shaft of the motor preferably (as illustrated in FIG. 5) by insertion into a retaining sleeve 40 on the rotating shaft and secured with a retaining bolt 41. In use, rotation of the rotating shaft by the motor rotates the auger so that the digging end of the auger drills a hole in a ground surface it is inserted into.

As illustrated in FIG. 2, the motor is pivotable with respect to the boom arm to a resting position where the auger is extended generally parallel to the longitudinal axis of the boom arm. An elongate auger stop 42 is upwardly extended from the base adjacent the first end of the boom arm and positioned adjacent the digging end of the auger when the auger is position in the resting position. In use, the auger stop is designed for helping hole the auger steady when positioned in its resting position.

A third telescopic fluidic piston cylinder actuator 43 is provided having has a pair of opposite ends, one of the ends of the third telescopic fluidic piston cylinder actuator is pivotally coupled to a second of the ends of the base and a second of the ends of the third telescopic fluidic piston cylinder actuator is pivotally coupled to the lower portion of the boom arm at a point between the ends of the boom arm. In use, extending and retracting of the third telescopic fluidic piston cylinder actuator pivots the boom arm with respect to the base to raise and lower the second end of the boom arm with respect to the base.

Figure 6:
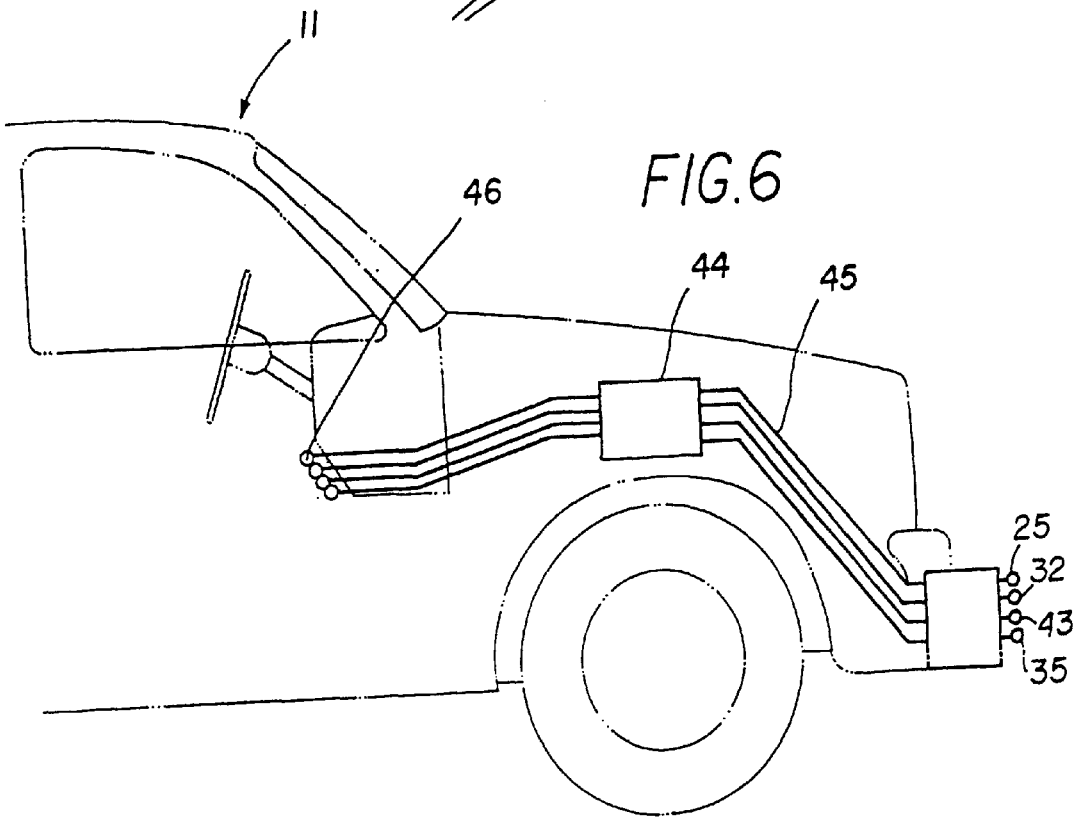
FIG. 6 is a schematic side view of the present invention illustrating the connections of the hydraulic pump.
Figure 7:
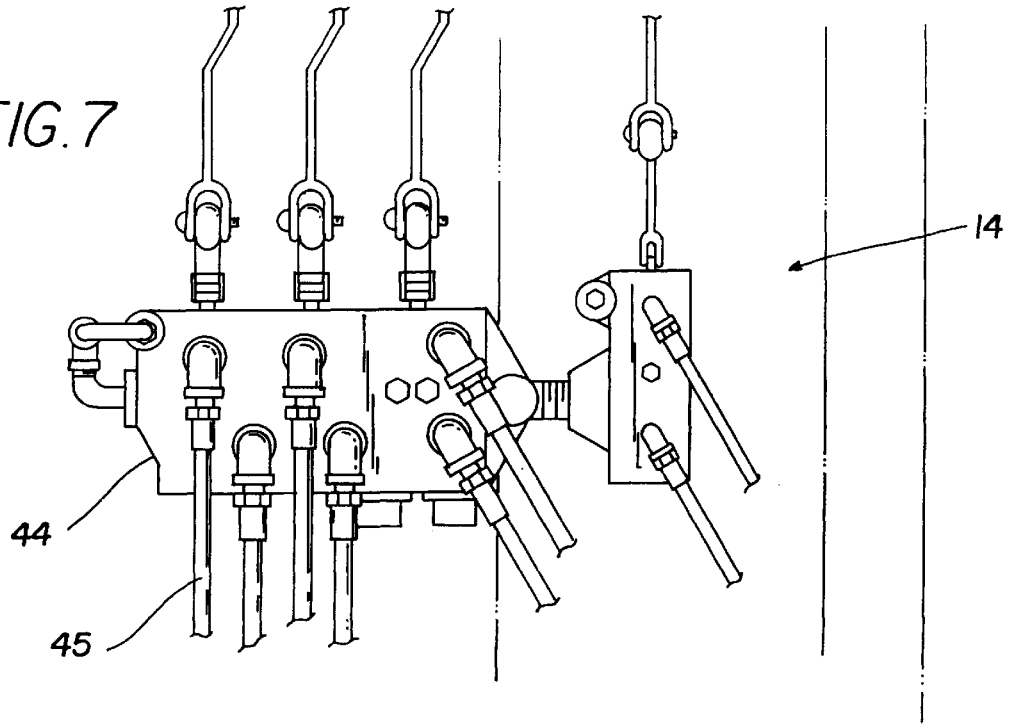
FIG. 7 is a schematic top view of the hydraulic pump in the engine compartment of a vehicle.

With reference to FIGS. 6 and 7, a hydraulic pump 44 is fluidly connected to the first, second, and third telescopic fluidic piston cylinder actuators by hydraulic conduits 45 to telescopically extended and retract the telescopic fluidic piston cylinder actuators by pumping hydraulic fluid between the hydraulic pump and the respective telescopic fluidic piston cylinder actuator. Preferably, the motor comprises a hydraulic motor to which the hydraulic pump is fluidly connected by hydraulic conduits such that pumping of from hydraulic fluid from the hydraulic pump to the hydraulic motor rotates the rotating shaft. Preferably, the hydraulic pump is mounted in the engine compartment of the vehicle so that the hydraulic pump may be operatively connected to the power plant (i.e., the engine and battery) of the vehicle to power the hydraulic pump to pump hydraulic fluid.

Figure 8:
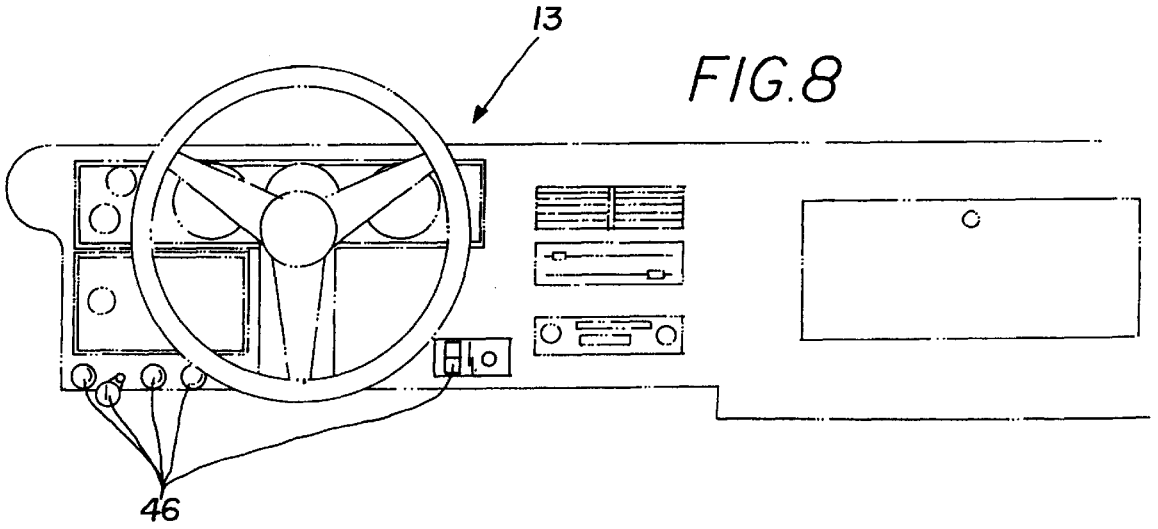
FIG. 8 is a schematic forwards view of the passenger compartment illustrating the preferred location of the controls for the hydraulic pump.

With reference to FIGS. 6 and 8, the hydraulic pump has a plurality of controls 46 for controlling operation of the hydraulic pump provided in the passenger compartment of the vehicle, the controls permitting a user to selective pump hydraulic fluid to the telescopic fluidic piston cylinder actuators and the hydraulic motor to control their operation.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hole digger system, comprising:

a spaced apart pair of adjustably extendible support braces;

said support braces each having a forwards end;

an elongate base having a pair of opposite ends;;

said base being pivotally coupled to said forwards ends of said support braces;

a telescopic boom arm having a pair of opposite ends and a longitudinal axis extending between said ends of said boom arm;

a first of said ends of said boom arm being pivotally coupled to a first of said ends of said base;

a motor being pivotally coupled to a second of said ends of said boom arm;

said motor having a rotating shaft outwardly extending therefrom;

an elongate auger having opposite mounting and digging ends, said mounting end of said auger being attached to said rotating shaft of said motors;

said boom arm having a lowered position wherein said boom arm and said base are extended substantially parallel to one another; and said base having a boom rest forwardly extending therefrom, said boom arm being rested on said boom rest when said boom arm is positioned in said lowered position.

2. The hole digger system of claim 1, wherein each of said support braces comprises a pair of elongate portions, one of said elongate portions of each support brace being telescopically extended from the other elongate portion of the respective brace.

3. The hole digger system of claim 1, wherein a first telescopic fluidic piston cylinder actuator is connected to said base and one of said support arms whereby extension and retraction of said first telescopic fluidic piston cylinder actuator pivots said base with respect to said support braces.

4. The hole digger system of claim 3, wherein a second telescopic fluidic piston cylinder actuator is provided in said boom arm for telescopically extending and retracting said boom arm along said longitudinal axis of said boom arm.

5. The hole digger system of claim 4, wherein a third telescopic fluidic piston cylinder actuator is provided having a pair of opposite ends, one of said ends of said third telescopic fluidic piston cylinder actuator being pivotally coupled to a second of said ends of said base, a second of said ends of said third telescopic fluidic piston cylinder actuator being pivotally coupled to said boom arm at a point between said ends of said boom arm.

6. The hole digger system of claim 5, further comprising a hydraulic pump being fluidly connected to said first, second, and third telescopic fluidic piston cylinder actuators.

7. The hole digger system of claim 6, wherein said motor comprises a hydraulic motor, said hydraulic pump being fluidly connected to said hydraulic motor such that pumping of hydraulic fluid from said hydraulic pump to said hydraulic motor rotates said rotating shaft.

8. The hole digger system of claim 1, wherein said support braces each have a hole therethrough adjacent said forwards end of the respective support brace, wherein said base has a spaced apart pair of pivot brackets, wherein each of said pivot brackets of said base has a hole therethrough, and wherein a pivot axle is extended through said holes of said support braces and said pivot brackets of said base to permit pivoting of said base with respect to said support arms.

9. A hole digger system, comprising:

a vehicle having a front end, a pair of sides, a passenger compartment, and an engine compartment;

a spaced apart pair of adjustably extendible support braces being mounted to said front end of said vehicle, said support braces being extended substantially parallel to one another;

each of said support braces comprising a pair of elongate portions, one of said elongate portions of each support brace being telescopically extended from the other elongate portion of the respective brace;

said support braces each having a forwards end forwardly extending from said front end of said vehicle;

said support braces each having a hole therethrough adjacent said forwards end of the respective support brace, said holes of said support braces being substantially coaxial with one another;

an elongate base having a pair of opposite ends, said base positioned in front of said front end of said vehicle, said base being extended substantially perpendicular to said support braces;

said base being pivotally coupled to said forwards ends of said support braces;

said base having a spaced apart pair of rearwardly extending pivot brackets, each of said pivot brackets of said base having a hole therethrough, said holes of said pivot brackets of said base being substantially coaxial with one another;

said forwards ends of said support brace being positioned between said pivot brackets of said base such that said holes of said support braces and said pivot brackets are generally coaxial with one another;

a pivot axle being extended through said holes of said support braces and said pivot brackets of said base to permit pivoting of said base with respect to said support arms about said pivot axle;

a first telescopic fluidic piston cylinder actuator being connected to said base and one of said support arms whereby extension and retraction of said first telescopic fluidic piston cylinder actuator pivots said base with respect to said support braces;

said first telescopic fluidic piston cylinder actuator being extended substantially parallel to said support braces;

a telescopic boom arm having a pair of opposite ends and a longitudinal axis extending between said ends of said boom arm;

said boom arm being telescopically extendable along said longitudinal axis of said boom arm and having a pair of elongate portions, one of said portions of said boom arm being telescopically inserted into the other of said portions of said boom arm;

a second telescopic fluidic piston cylinder actuator being provided in said boom arm for telescopically extending and retracting said boom arm along said longitudinal axis of said boom arm;

a first of said ends of said boom arm being pivotally coupled to a first of said ends of said base to permit pivoting of said boom arm with respect to said base about a pivot axis extending substantially perpendicular to said longitudinal axis of said boom arm;

said boom arm having a lowered position wherein said boom arm and said base are extended substantially parallel to one another;

said base having a boom rest forwardly extending therefrom, said boom arm being rested on said boom rest when said boom arm is positioned in said lowered position;

a motor being pivotally coupled to a second of said ends of said boom arm, wherein a mounting bracket pivotally couples said motor to said second end of said boom;

said motor having a rotating shaft outwardly extending therefrom;

an elongate auger having opposite mounting and digging ends, said mounting end of said auger being detachably attached to said rotating shaft of said motor;

a third telescopic fluidic piston cylinder actuator having a pair of opposite ends, one of said ends of said third telescopic fluidic piston cylinder actuator being pivotally coupled to a second of said ends of said base, a second of said ends of said third telescopic fluidic piston cylinder actuator being pivotally coupled to said boom arm at a point between said ends of said boom arm;

a hydraulic pump being fluidly connected to said first, second, and third telescopic fluidic piston cylinder actuators;

wherein said motor comprises a hydraulic motor, said hydraulic pump being fluidly connected to said hydraulic motor such that pumping of hydraulic fluid from said hydraulic pump to said hydraulic motor rotates said rotating shaft;

said hydraulic pump being mounted in said engine compartment of said vehicle; and said hydraulic pump having a plurality of controls for controlling operation of said hydraulic pump provided in said passenger compartment of said vehicle.

* * * * *